US008152213B2

(12) United States Patent
Fortune

(10) Patent No.: US 8,152,213 B2
(45) Date of Patent: Apr. 10, 2012

(54) MULTI-MODE PROBE TWEEZER

(76) Inventor: William S. Fortune, Malibu, CA (US)

( * ) Notice: Subject to any disclaimer, the term of this patent is extended or adjusted under 35 U.S.C. 154(b) by 258 days.

(21) Appl. No.: 12/586,261

(22) Filed: Sep. 18, 2009

(65) Prior Publication Data

US 2011/0068594 A1 Mar. 24, 2011

(51) Int. Cl.
*B25B 7/00* (2006.01)

(52) U.S. Cl. ..... 294/99.2

(58) Field of Classification Search ..... 294/3, 24, 294/86.4, 99.2, 100, 104, 902; 433/159, 433/162; 606/131, 133, 210, 211
See application file for complete search history.

(56) References Cited

U.S. PATENT DOCUMENTS 1,133,334 A * 3/1915 Strycker ..... 269/6
2,449,521 A * 9/1948 Warner ..... 219/161
2,623,152 A * 12/1952 Ammon ..... 219/234
2,667,094 A * 1/1954 Potter ..... 81/9.4
3,752,017 A * 8/1973 Lloyd et al. ..... 81/9.44
5,385,471 A * 1/1995 Chuen ..... 433/153
5,764,117 A * 6/1998 Tada et al. ..... 333/206
5,914,612 A 6/1999 Koken et al.
5,938,258 A * 8/1999 Femling ..... 294/104
5,939,890 A 8/1999 Kohen et al.
6,737,875 B2 5/2004 Davis et al.
6,746,454 B2 * 6/2004 Winterbottom et al. ..... 606/99
6,750,431 B2 * 6/2004 Miyazaki ..... 219/234
7,269,892 B2 * 9/2007 Miyazaki ..... 29/739
7,439,727 B2 10/2008 DeFlorio
7,456,642 B2 11/2008 Saulnier et al.

* cited by examiner

*Primary Examiner* — Saul Rodriguez
*Assistant Examiner* — Stephen Vu
(74) *Attorney, Agent, or Firm* — Leon D. Rosen

(57) ABSTRACT

A tweezer that is especially useful for testing and repair of electronic circuits includes a pair of resilient blades (14, 16) with rear ends (22) fixed at a mount (24) to a pair of dielectric plastic mounting blocks (110, 112) that are clamped together by a clamping tube (140) that can be slid on and off. Front portions of the blades are connected to a spacing adjuster (80) that includes a thumb wheel (86) that can be turned to adjust the separation of the front ends (20) of the blades. The tweezer can be used as a regular tweezer, and the blades can be used as independent electrical probes.

7 Claims, 3 Drawing Sheets

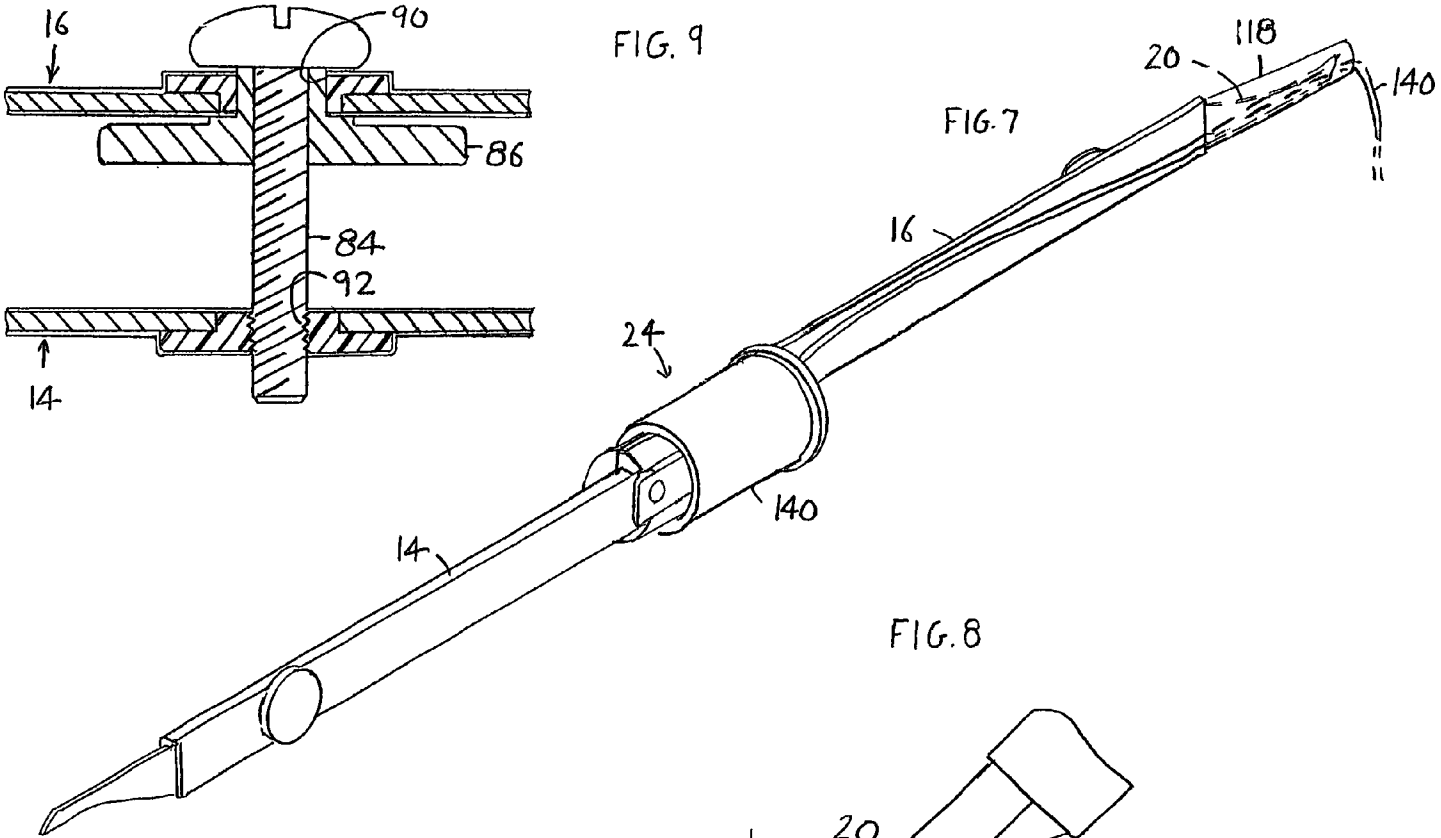
FIG. 7
FIG. 8
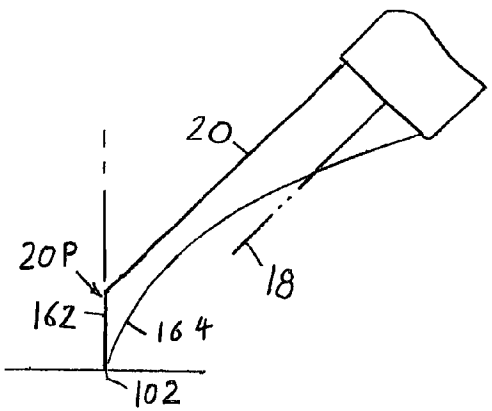
FIG. 9

MULTI-MODE PROBE TWEEZER

BACKGROUND OF THE INVENTION

A tweezer (sometimes spelled "tweezers") commonly includes a pair of resilient blades having rear ends fixed together at a predetermined spacing and oriented so the front ends are spaced apart. A person presses the blades together with the thumb and index fingers of one hand, so the blade front ends clamp against an object. A tweezer can be used by a technician to repair circuit boards and other electronic equipments as by using the tweezer to hold small circuit components while soldering or unsoldering them. For in-the-field repairs and testing it is desirable to make each tool, such as the tweezer, highly versatile but of simple construction so a technician can perform many tasks while carrying a minimum number of tools.

SUMMARY OF THE INVENTION

In accordance with one embodiment of the invention, a tweezer is provided which is of relatively simple construction but which is highly versatile in performing many functions especially for an in-the-field electronic circuit repair technician. The tweezer includes a pair of resiliently bendable blades with rear ends that are fixed together by a mount, and with free front ends. Electrically conductive wires are connectable and disconnectable from each of the blades. A spacing adjuster device which is connected to blade locations lying between the blade front and rear ends, can be operated to fix the spacing between the blade front ends. The blade locations whose separation is fixed by the spacing adjuster, are preferably closer to the front ends of the blades than the blade rear ends, to facilitate fine adjustment of blade separation especially when the tweezers blades are used as electrical probes.

The spacing adjuster device includes a small screw and a thumbwheel fixed to the screw. The screw is threadably engaged with a threaded hole in a dielectric bushing on one blade and freely turns with respect to the other blade. The blades each comprise a resilient blade of uniform thickness and a dielectric covering that is of increased thickness at the spacing adjuster to assure good threadable connection with the screw.

The mount that clamps together the rear ends of the blades, includes a pair of dielectric (e.g. molded plastic) mounting blocks that are each fixed to one of the blades. A clamping tube Is slidable around the blocks to clamp them together. The clamping tube also can be slid off to free the blocks so the blades can be moved independently. Each mounting block forms an independent electrical connector that can connect to a terminal at the end of a wire such as a wire extending from an ohmmeter.

The novel features of the invention are set forth with particularity in the appended claims. The invention will be best understood from the following description when read in conjunction with the accompanying drawings.

BRIEF DESCRIPTION OF THE DRAWINGS

FIG. 7 is an isometric view showing another configuration of the blades of the tweezer of FIG. 1.

FIG. 8 is a partial side elevation view of the front end of one of the blades of the tweezer of FIG. 1.

FIG. 9 is a partial top view of the tweezer of FIG. 6, with the adjuster device repositioned to spread apart blade locations.

DESCRIPTION OF THE PREFERRED EMBODIMENTS

Figure 1:
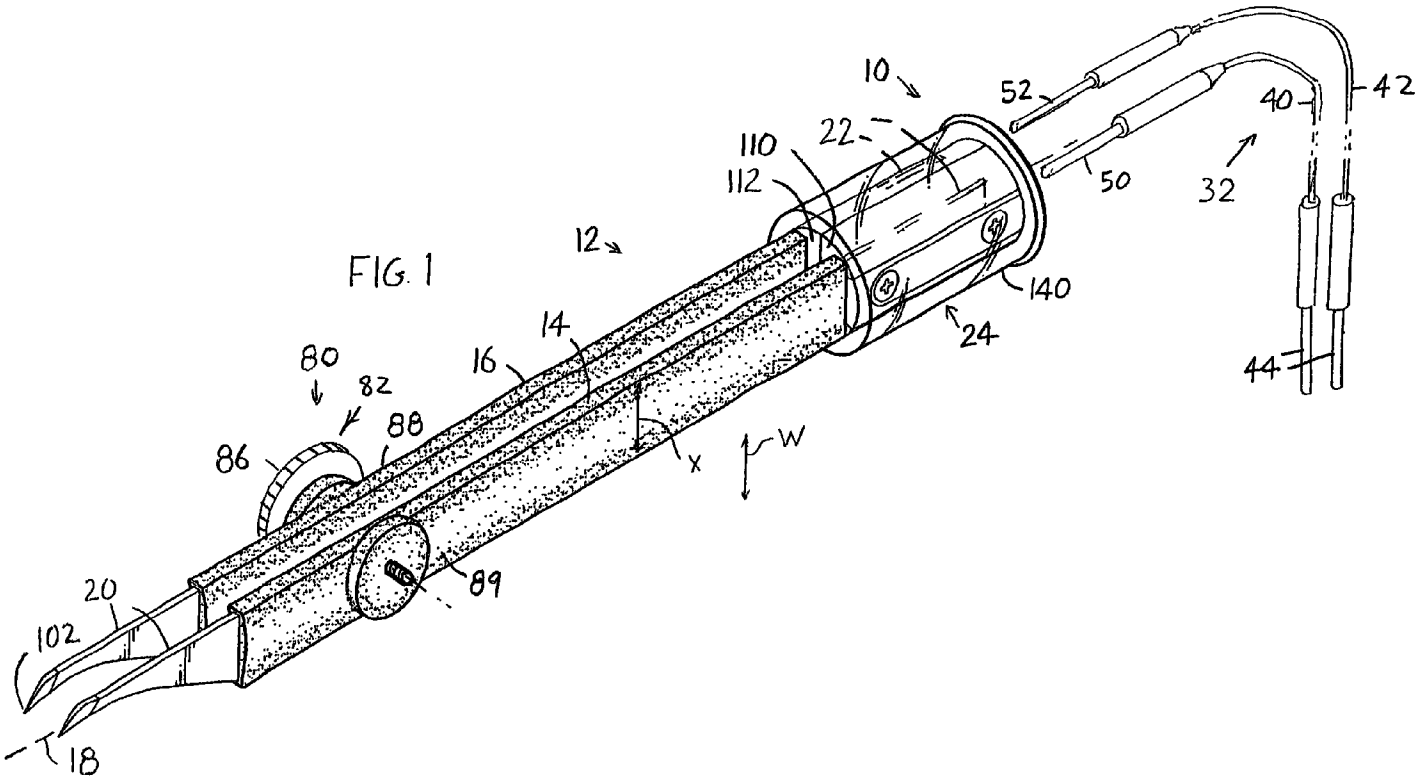
FIG. 1 is an isometric view of a tweezer of the invention, and showing a pair of wires with pin terminals that are connectable to the rear ends of the tweezer blades.
Figure 2:
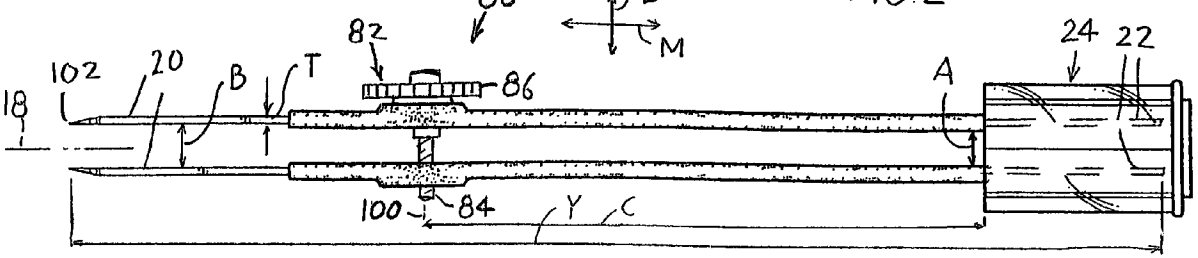
FIG. 2 is a top view of only the tweezer of FIG. 1.

FIGS. 1 and 2 show a tweezer assembly 10 of the invention comprising a tweezer 12 which has an axis 18 and which includes a pair of resilient blades 14, 16 that have front ends 20 and rear ends 22 spaced along the axis. The rear ends 22 of the blades are clamped together at a predetermined spacing A and orientation, by a mount 24, so the blade front ends 20 are spaced apart by a predetermined distance B. Applicant prefers that the blades are oriented so they extend parallel to each other and so the front end spacing B equals the rear end spacing A when the blades are not deflected. The blades each has a blade thickness T as its front as measured in a lateral direction L, a blade width X as measured in a width direction W, and a blade length Y as measured in a longitudinal direction M. The tweezer axis 18 extends parallel to the length direction.

Figure 5:
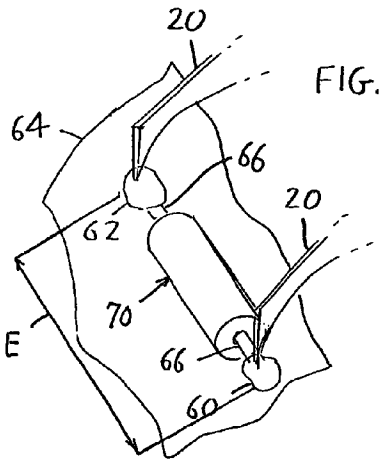
FIG. 5 is an isometric view showing one way in which the tweezer of FIG. 1 can be used.

The tweezer assembly also comprises an electrical coupling 32 that includes a pair of insulated electrical wires 40, 42 with contacts 44 at their rear ends for connecting to an instrument such as an ohmmeter. The wires also have front ends fixed to pin contacts 50, 52 that each can be connected to a different one of the blades 14, 16. This allows the blades to be used as electrical probes. FIG. 5 shows one situation where the blade front ends 20 are placed against solder connections 60, 62 on a circuit board 64 where leads 66 of an electronic circuit component 70 are connected to conductive traces on the circuit board. Such connection can be used to determine the impedance of the circuit component, or to pick up signals for analysis when the circuit is functioning, or to inject signals, etc.

Figure 6:
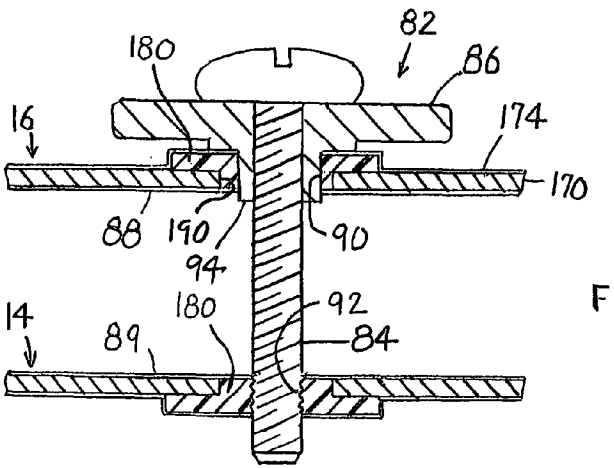
FIG. 6 is a partial sectional view of the spacing adjuster and a portion of the blades of the tweezer of FIG. 2.

In many circuits, many terminals such as at the solder connections 60, 62 are located at predetermined spacings, such as shown at E in FIG. 5. The spacing may be small such as one or a few millimeters. In FIG. 2 the spacing B between the front ends of undeflected blades is 8 mm. A technician may squeeze the blades together with his thumb and index fingers to obtain the proper spacing E such as 3 mm, but it can be tedious to do so during many measurements. Applicant provides a spacing adjuster 80, shown in FIG. 2, which is of simple construction and which allows a technician to easily adjust the distance B between the front ends 20 of the blades to temporarily fix the blade spacing. The spacing adjuster 80 includes a spacing adjuster device 82 comprising a threaded screw 84 and a thumb wheel 86 that is fixed to the screw to turn it. By "fixed", applicant is describing that the screw is tightened on the thumb wheel so they turn together, but they can be screwed apart when a considerable torque is applied. As shown in FIG. 6, the device 82 can be installed by projecting the screw 84 through an unthreaded hole 90 in a mid location 88 of blade 16 and then turning the device to thread the screw into a threaded hole 92 in a mid location 89 of the other blade 14. A shoulder collar 94 facilitates turning in the unthreaded hole 90 and serves as a stop to prevent binding in spreading apart the blades (as in FIG. 9). The spacing adjuster device of FIG. 6 can be turned until the blade front tips are at the desired spacing E (FIG. 5). Deflecting the blade front ends closer together is also useful to hold a small object without constantly applying forces to the blades. Deflecting the front ends closer together also minimizes the amount of additional deflection ("squeeze travel") when repeatedly grasping small parts.

The center of the spacing adjuster lies at 100 (FIG. 2) on the axis of the shank of the screw 84. It is possible to move the blade front ends closer together by the use of a mechanism incorporated into the mount 24 that clamps the rear ends of the blades and that can change the orientation of the blades. That is, the rear ends 22 of the blades can be tilted so the blade front ends 20 are at a predetermined spacing, as is described in U.S. Pat. No. 5,914,612. However, in that case a very small change in blade angle results in a large change in the spacing of the blade front ends so it can be difficult to obtain and maintain a precise adjustable blade front end spacing. Also, it is difficult to apply a secure clamping force to the front ends of the resilient blades to securely hold an object, if the clamping force is applied by orienting the rear ends of the blades. Applicant prefers to place the center 100 of the spacing adjuster so it is spaced forward of the mount by a distance C that is a plurality of times the spacing A between the blade rear ends, and prefers even more to place the adjuster center 100 closer to the blade front tips 102 than to the mount, especially for secure holding of an object by the tweezer.

The spacing adjuster can be used to press apart front portions of the blades, as shown in FIG. 9. This allows the blades to clamp against the insides of larger components or to achieve a larger spacing of the blade front ends. To use the configuration of FIG. 9, the screw is unscrewed from the thumbwheel and they are placed in the position of FIG. 9.

Figure 4:
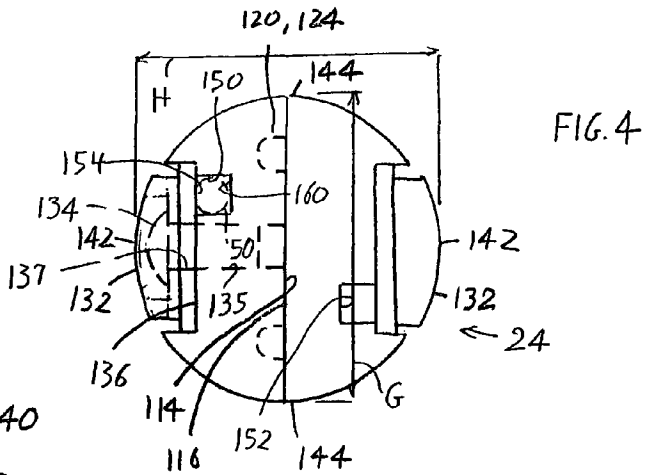
FIG. 4 is rear end view of the mount of FIG. 2.
Figure 3:
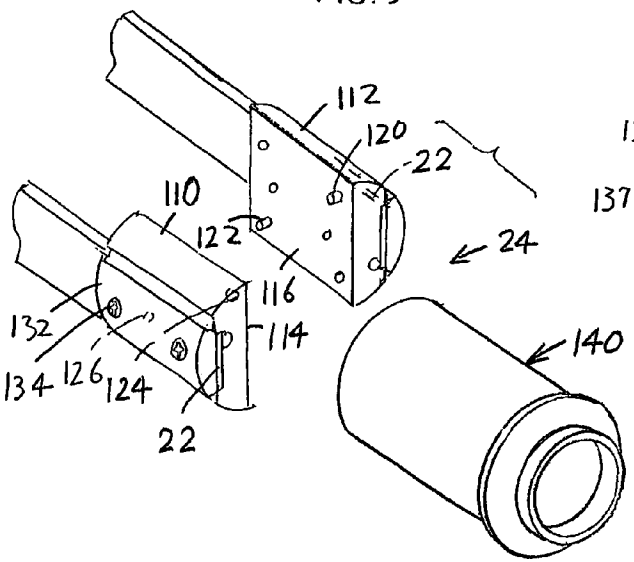
FIG. 3 is a partial exploded isometric view of the rear portion of the tweezer of FIG. 2.

FIGS. 3 and 4 show that the mount 24 that holds the blade rear ends 22 includes a pair of identical molded plastic dielectric mounting blocks 110, 112 that are each fixed to one of the blades. The mounting blocks have flat adjacent surfaces 114, 116 that lie facewise against each other. A pair of projections 120, 122 project from each block into a corresponding hole 124, 126 of the other block. A pair of molded dielectric cover plates 132 receive mount screws 134 that are screwed into initially-unthreaded holes 135 in the blocks and through blade holes 137 to hold the blade rear ends securely in place against flat surfaces 136 of the blocks. The mount screws are self threading in the holes 135. The blocks 110, 112 with the blades thereon can be clamped together by a clamping tube 140. The distance between opposite surfaces 142 (FIG. 4) of the cover plates is slightly greater than the distance between opposite sides 144 of the mounting blocks, so the tube is deformed slightly. This results in a slight interference fit of the tube around the cover plates, so the tube is securely held in place to securely clamp the blocks together.

In a tweezer of the construction shown that applicant has constructed, the opposite sides 144 of the blocks were spaced a distance G of 13.7 mm while the opposite surfaces 142 of the cover plates were spaced a distance H of 13.8 mm, resulting is a slight deformation of the tube from a cylindrical shape.

The pin contacts 50, 52 (FIG. 1) that lie at the ends of the wires, are connected to the tweezer blades 14, 16 by forming the blocks with pin receiving elongated holes 150, 152 (FIG. 4). Each pin-receiving hole has one hole wall 154 formed by a face of a blade and has other hole walls 160 formed by the dielectric walls of a mounting block. The other hole walls 160 can be walls of a cylinder, square, triangle or other regular polygon, with a square being shown. This allows connection of a pin directly to one of the blades without distorting the blade.

In some instances, a technician must use the blades to engage contacts that lie at the end of a narrow passage or hole, where the passage is longer than the distance between opposite ends of the blades. In that case, the blades can be mounted as shown in FIG. 7, with the blades extending in opposite directions from the mount 24. The fact that the mounting blocks have projections 120, 122 (FIG. 4) and holes 124, 126 that are symmetrically arranged about two perpendicular lines that lie on the facewise adjacent block surfaces 114, 116 results in the blocks being clampable as shown in FIG. 7. A protective sleeve 118 can be slid around the end 20 of blade 16. The sleeve 118 also guides a wire 140.

FIG. 8 shows that each blade front end 20 has a front end part 20P with a pointed tip 102 and with opposite edges 162, 164 that converge to the tip. Applicant forms the upper edge 162 so it extends about 45° (20° to 70°) to the tweezer axis 18 when the blade opposite faces lie in vertical planes. A person usually holds the tweezer, when the tips 102 engage terminals on a horizontal circuit board, so the tweezer axis 18 is about 45° to the horizontal. By orienting the upper edge 162 vertically, applicant minimizes the possibility that a blade front end will unintentionally contact another terminal on the circuit board.

Applicant has constructed and successfully tested a tweezer of the construction shown, with the blades each having a core 170 (FIG. 6) of stainless steel of 0.040 inch (1.0 mm) thickness. The blade cores are each covered by a shrink tubing 174 of dielectric material of a thickness of 0.015 inch (0.38 mm) except at their bare front and rear end portions. The shrink tubing also encloses a dielectric bushing 180 that form the inner walls of the holes 90, 92 in the blades in which the spacer adjusting device is located. The bushings lie in holes 190 in the blades. The bushings 180 form stops that remind a person to not hold the blades closer to the tips (which may be hot).

Thus, the invention provides a versatile tweezer for the testing and repair of electronic circuits, especially in the field. The tweezer includes a pair of resilient blades that have rear ends fixed together at a predetermined spacing and orientation (preferably parallel). The tweezer also includes a spacing adjuster lying forward of the rear ends and preferably closer to the blade front ends than the rear ends, that can adjust the spacing of the blade front ends. The spacer adjuster is a device that includes a simple screw and a thumbwheel tightened (fixed in normal use) to the screw, with the screw threadable mounted in a hole in a dielectric bushing in one of the blades. A mount that fixes the positions and orientations of the rear ends of the blades, includes a pair of identical molded polymer mounting blocks. Each block is fixed to a different one of the blades, as by screws that are out of contact with the blade cores, that clamp each blade between a cover plate and a mounting block. The blocks are placed with their adjacent block surfaces lying facewise against each other, and a clamping tube is slid around the blocks to complete the mounting. The block adjacent surfaces have projections and holes for simple connections to each other. The blocks can be separated to form independent probes. Applicant notes that tweezer blade tips can be mounted on tweezer blade front ends.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A versatile tweezer which includes first and second bendable tweezer blades spaced apart in a lateral direction, each of said first and second blades having an average lateral thickness and having an average height that is greater than its average thickness, and said first and second blades each having front and rear ends (20, 22), said tweezer also having a mount (24) that clamps together locations on said first and second blade rear ends so they are spaced apart by a first distance (A);

at least said first blade comprises a metal core (170) that has a mounting hole (190), a dielectric bushing (180) that lies in the mounting hole, and a shrink tubing (174) that covers at least a portion of said core and that covers said bushing.

2. A versatile tweezer which includes first and second bendable tweezer blades spaced apart in a lateral direction, each of said first and second blades having an average lateral thickness and having an average height that is greater than its average thickness, and said first and second blades having front and rear ends (20, 22), said tweezer also having a mount (24) that clamps together locations on said first and second blade rear ends so they are spaced apart by a first distance (A) and are oriented with the front ends of the first and second blades spaced apart by a second distance (B) when said first and second blades are not forced to bend, said first and second blades being resiliently bendable to change the spacing of their front ends, including:

a spacing adjuster (80) connected to blade mid locations (88, 89) that are spaced a third distance (C) forward of said blade rear ends, said spacing adjuster constructed to temporarily fix the distance between said blade mid locations, where said third distance (C) is a plurality of times said first distance (A);

said mount includes a pair of dielectric mount blocks (110, 112) with each of said blades clamped to a different one of said dielectric mount blocks, and a tube (140) that is slideable around said pair of dielectric mount blocks to hold the dielectric mount blocks clamped together.

3. The tweezer described in claim 2 wherein:

said tweezer has an axis (18) lying halfway between said blades, and each of said mount blocks has a pin-receiving hole (150, 152) that extends parallel to said axis and that has a cross-section to closely receive a cylindrical contact pin, each of said pin-receiving holes having one hole wall (154) formed by one of said blades.

4. A versatile tweezer which includes first and second bendable tweezer blades spaced apart in a lateral direction, each of said first and second blades having an average lateral thickness and having an average height that is greater than its average thickness, and said first and second blades having front and rear ends (20, 22), said tweezer also having a mount (24) that clamps together locations on said first and second blade rear ends so they are spaced apart by a first distance (A) and are oriented with the front ends of the first and second blades spaced apart by a second distance (B) when said first and second blades are not forced to bend, said first and second blades being resiliently bendable to change the spacing of their front ends, including:

a spacing adjuster (80) connected to blade mid locations (88, 89) that are spaced a third distance (C) forward of said blade rear ends, said spacing adjuster constructed to temporarily fix the distance between said blade mid locations, where said third distance (C) is a plurality of times said first distance (A);

at least said first blade comprises a metal core (170) that has a mounting hole (190), a dielectric bushing (180) that lies in the mounting hole, and a shrink tubing (174) that covers at least a portion of said core and that covers said bushing.

5. A versatile tweezer which includes a pair of bendable tweezer blades spaced apart in a lateral direction, each of said blades having an average lateral thickness and an average height that is greater than its average thickness, and said blades having front and rear ends (20, 22), said tweezer also having a mount (24) that clamps said blade rear end so they are spaced apart by a first distance (A) and are oriented with the front ends of the blades spaced apart by a second distance (B) when said blades are not forced to bend, said blades being resiliently bendable, including:

a spacing adjuster (80) that includes a rotatable device (82) comprising a threaded screw (84) and a thumbwheel (86) fixed to said screw to turn it, both of said blades having hole walls forming screw-receiving holes (90, 92) with one of said holes (92) being threadably connected to said threaded screw, and with said rotatable device bearing against walls of the other hole, so as the thumb wheel and threaded screw turn they force said arm front ends to move to different spaced distances;

each of said blades has laterally opposite sides and has a predetermined thickness over a majority of its sides, but each of said blades has a mid location (88, 89) of increased thickness around its screw-receiving hole; and including a quantity (174, 180) of insulation covering a portion of each of said blades rearward of the blade front end, with said quantity (180) on said insulation forming walls of each of said screw-receiving holes.

6. A versatile tweezer which includes a pair of bendable tweezer blades that are spaced apart in a lateral direction, said tweezer blades having front and rear ends (20, 22) spaced apart along a tweezer axis (18), said tweezer also having a mount (24) that fixes said blade rear ends so they are spaced apart by a first distance (A) and are oriented with their front ends spaced apart by a second distance (B) when said tweezer blades are not forced to bend, said tweezer blades being resiliently bendable to change the spacing of their front ends, wherein:

said mount comprises a pair of mounting blocks (110, 112) that lie primarily on opposite sides of said tweezer axis and that have block surfaces (114, 116) that engage each other, each of said mounting blocks having a block outer side with each of said tweezer blades mounted on one of said block outer sides;

said mount also comprising a clamping tube (140) that is slidable over said mounting blocks to clamp said mounting blocks against each other;

said blade rear ends each has a blade hole (137) and said mounting blocks each has a threaded block hole (135);

said mount comprises a pair of cover plates (132) that each lies against a corresponding one of said blades, and a pair of mount screws (134) that each has a screw head that presses one of said blades against a mounting block and a screw threaded shank that is threadably engaged with one of said threaded block holes.

7. The tweezer described in claim 6 wherein:

each of said mounting blocks has a pin-receiving hole (150, 152) that extends parallel to said tweezer axis and that has a cross-section to closely receive a cylindrical contact pin, each of said pin-receiving holes having one hole wall (154) formed by one of said tweezer blades.

* * * * *